United States Patent [19]

Miller

[11] 4,235,325

[45] Nov. 25, 1980

[54] HEATER TREATER WASTE HEAT RECOVERY SYSTEM

[76] Inventor: Carl L. Miller, Rte. 1, Box 6619, Midkiff, Tex. 79755

[21] Appl. No.: 972,722

[22] Filed: Dec. 26, 1978

[51] Int. Cl.[3] ..... C10G 1/00

[52] U.S. Cl. ..... 196/46; 122/20 B

[58] Field of Search ..... 196/14.52, 46; 422/204; 122/20 B; 432/222

[56] References Cited

U.S. PATENT DOCUMENTS

| | | | |
|---|---|---|---|
| 780,736 | 1/1905 | Stack | 122/20 B |
| 1,671,001 | 5/1928 | Wild et al. | 122/20 B X |
| 2,734,593 | 2/1956 | McKelvey, Jr. et al. | 55/175 |
| 3,671,198 | 6/1972 | Wallace | 422/204 X |

*Primary Examiner*—William A. Cuchlinski, Jr.
*Attorney, Agent, or Firm*—Marcus L. Bates

[57] ABSTRACT

A waste heat recovery system for a heater treater which elevates the overall energy imparted into crude oil from a finite amount of combustion gases. The system includes a vertical heat exchanger supported from the shell of the heater treater. The exchanger has an outer housing within which a plurality of longitudinally arranged tubes are disposed. Untreated crude flows through the interior of the tubes while waste heat from the fire tube is conducted into the lower end portion of the housing so that the outer surface of the tubes contact and extract heat from the flue gases. The flue gases exit through the upper end of the housing. The temperature elevation of the incoming crude is controlled by a damper assembly located at the lower extremity of the exchanger, which admits atmospheric air into the housing. The incoming untreated crude oil is elevated in temperature, which increases the efficiency of the unit by lowering the gas consumption and increasing the throughput and enables the treated crude oil to leave the heater treater at an elevated temperature.

8 Claims, 6 Drawing Figures

HEATER TREATER WASTE HEAT RECOVERY SYSTEM

BACKGROUND OF THE INVENTION

During the production and gathering of crude oil in the oilfield, the crude produced from the borehole contains various undesirable substances, including water, sour gas, and foreign debris. It is therefore desirable to treat the crude before it is placed in the oil pipeline. A heater treater is usually employed for separating the crude from these other undesirable substances, and the treated oil is called "pipeline oil" because of its cleanliness. The heater treater causes the water and debris to gravitate in a downward direction and the sour gas to rise in an upward direction so that the pipeline oil emerges from the heater treater. A fire tube combustion type heat exchanger heats the contaminated incoming crude oil to a predetermined and closely controlled maximum temperature so as to prevent the paraffins from separating therefrom. Heater treaters are available from a number of different commercial manufacturers.

Until recently, there was usually an abundance of natural gas available for the fire tube of the heater treater, and no one was particularly concerned over the efficiency of combustion of the fire tube burner. As a matter of fact, when most of the present day heater treaters were designed and installed in the oilfield, natural gas was a waste product, and it was common to see the entire oilpatch lit up at night from the "flares" which wasted the excess natural gas into the atmosphere.

The crude leaving the heater treater must be pumped to a storage tank; and therefore, especially in the winter time, it is desirable that the oil have a low viscosity to facilitate flow through the pipeline.

It is common to utilize the treated hot oil to heat the incoming untreated crude. This represents an advantage during the warm summer months, but is often a detriment during the winter months, especially where the treated crude must be pumped a long distance.

It would therefore be desirable to increase the efficiency of a heater treater by utilizing the wasted flue gases from the combustion burner of the fire tube, thereby enabling the oil-to-oil heat exchanger to be eliminated, and also enabling greater thermal efficiency of the entire heater treater system to be achieved. Such a desirable expedient is the subject of this invention.

THE PRIOR ART

McKelvey, Jr., et al, U.S. Pat. No. 2,734,593; Walker, U.S. Pat. Nos. 2,181,686 and 2,942,689; and Perry, U.S. Pat. No. 3,422,028 show heater treaters of the past art and the use of an oil-to-oil heat exchanger. Kinzelmann, U.S. Pat. No. 2,521,462; Shannon, U.S. Pat. No. 304,462; Heapts, U.S. Pat. No. 1,896,671; and Ranebo, U.S. Pat. No. 3,295,503 show waste heat exchangers. None of the art of record, however, discloses a waste heat exchanger associated with a heater treater and which uses spent combustion gases from a fire tube heater.

SUMMARY OF THE INVENTION

A waste flue gas heat exchanger for increasing the efficiency of a crude oil heater treater. The incoming, untreated crude flows through the waste flue gas heat exchanger of the present invention and into the inlet of the heater treater. Waste flue gases from the fire tube exchanger of the heater treater is routed in parallel flow relationship through the exchanger of the present invention, so that a considerable quantity of thermal energy is transferred from the waste flue gases into the untreated crude.

The heat exchanger of the present invention is vertically mounted to the sidewall of the heater treater, and a special air valve is provided in the inlet end of the waste flue gas heat exchanger. The height of the exchanger housing provides adequate stack action whereby both atmospheric air and waste heat upwardly flows therethrough in a controlled ratio. The quantity of atmospheric air admixed with the waste flue gases controls the outlet temperature of the untreated crude flowing from the waste heat exchanger and into the heater treater.

The present invention enables greater efficiency to be realized from prior art heater treaters, lowers the gas consumption of the fire tube heater, and has the additional advantage of warming the existing treated crude to a higher temperature so that it more easily flows through the downstream piping system.

Accordingly, a primary object of the present invention is the provision of a waste flue gas heat exchanger in combination with a heater treater which increases the overall efficiency of the heater treater apparatus.

Another object of the present invention is the provision of an improved system for treating crude oil which conserves energy.

A further object of the present invention is the provision of a waste flue gas heater exchanger apparatus which preheats untreated crude oil by utilizing waste flue gases from a heater treater in a manner which controls the amount of preheat imparted into the incoming untreated crude.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
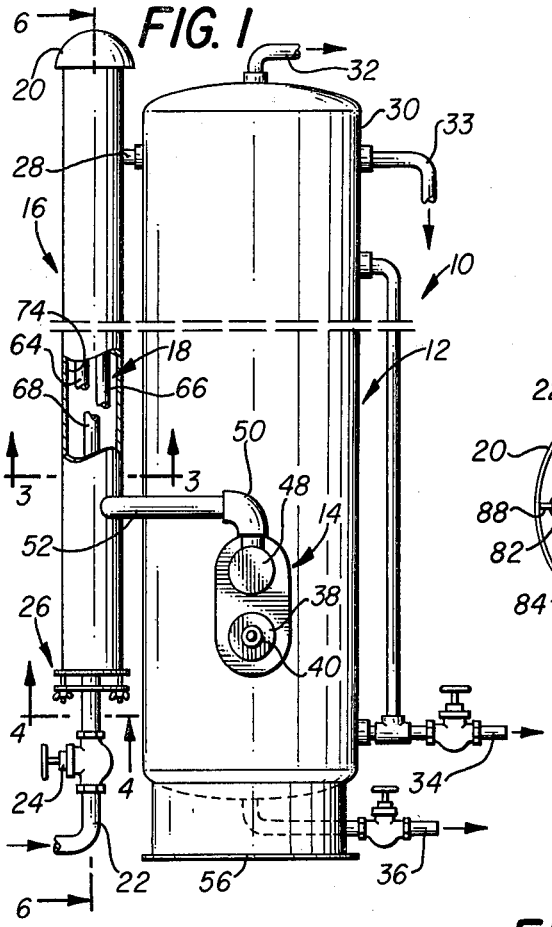
FIG. 1 is a side elevational view of a waste flue gas heat exchanger in combination with a heater treater apparatus.
Figure 3:
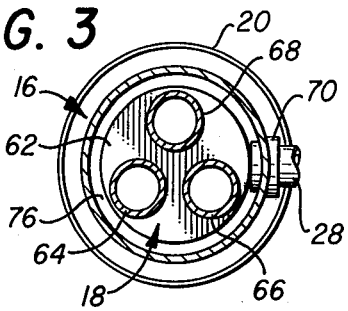
FIGS. 3, 4, and 6, respectively, are cross-sectional views taken along lines 3—3, 4—4, and 6—6, respectively, of FIG. 1; and, FIG. 5 is a perspective view of the apparatus disclosed in FIG. 6.
Figure 4:
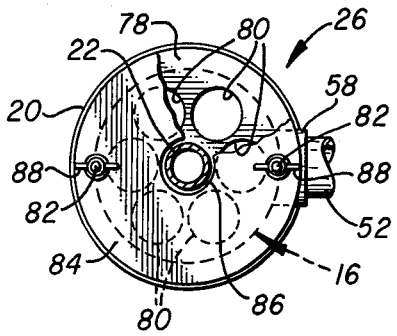
Figure 2:
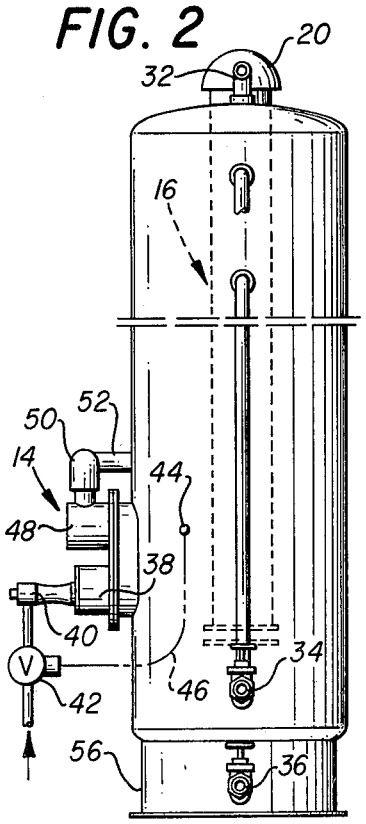
FIG. 2 is an elevational view of the apparatus disclosed in FIG. 1, viewed from a different side thereof.

In FIGS. 1 and 2, there is seen the combination 10 of the present invention, which includes a heater treater 12 having a fire tube heat exchanger 14. A waste heat recovery apparatus 16, made in accordance with the present invention, is attached in spaced relationship respective to the uppermost end of the exchanger.

Cold, untreated crude inlet 22 is connected to valve 24 and continues into the exchanger of the present invention. A damper assembly 26 controls flow of atmospheric air into the interior of the exchanger. Heated, untreated crude flows through the exchanger and then into the heater treater by means of conduit 28.

Separated gas outlet 32 is located in the uppermost end of the heater treater, while a treated crude outlet 33 is formed in a sidewall thereof at a location above a separated water outlet 34. Drain 36 is located in the lower extremity of the heater treater vessel.

As seen illustrated in FIG. 1, together with FIG. 2, the fire tube assembly 14 has an inlet end 38 to which a combustion burner 40 is attached. Control valve 42 is connected to a thermostat 44 by means of conduit 46. The outlet end 48 of the fire tube is provided with an elbow 50 which is connected to the housing of the exchanger by piping 52. Numeral 56 indicates the base of the heater treater which usually is supported on a slab of concrete.

Figure 6:
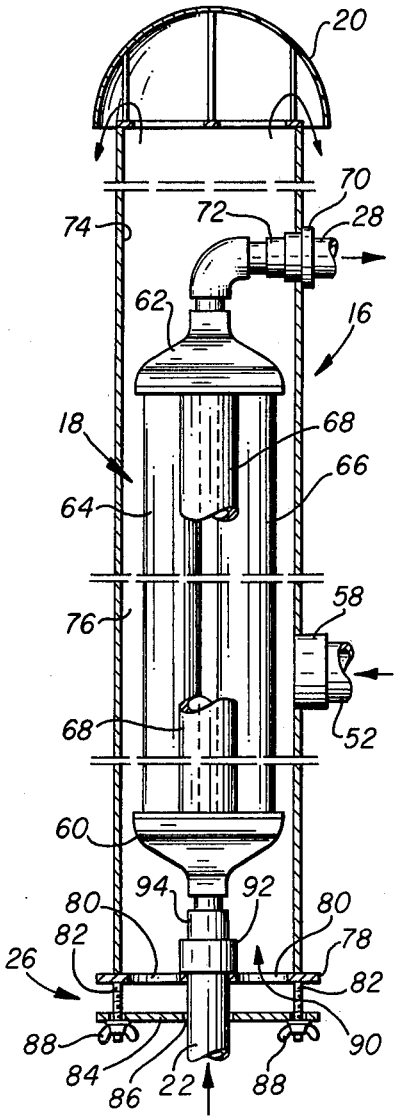
Figure 5:
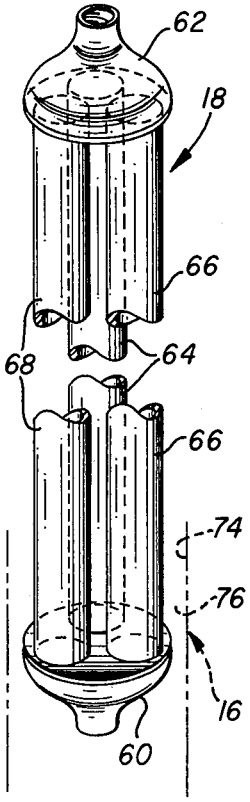

As seen in FIGS. 5 and 6, coupling member 58 enables piping 52 to be removed from the housing of the exchanger. The housing includes spaced inlet and outlet headers 60 and 62, which preferably are axially aligned within the housing. A tube bundle 18 comprising a plurality of heat exchange tubes 64, 66, and 68 have the opposed ends thereof connected to the headers. Boss 70 receives piping 28 therethrough while coupling 72 enables piping 28 to be disconnected from header 62. The tubes and headers are positioned to provide for annular area 76 about which atmospheric air and flue gases can flow, as will be described in greater detail later on.

The atmospheric air control 26 includes a flange 78 which is attached to the lower terminal end of the exchanger housing. The flange includes a plurality of radially spaced-apart apertures 80 formed therein. A pair of opposed studs 82 are mounted to flange 78 and bottom support a plate member 84 in adjustable, spaced relationship respective to flange 78. The plate member is apertured at 86, as well as being apertured to freely receive the studs 82 therethrough, so that wing nuts 88 can be turned to adjust the spaced-apart relationship between the flange and the plate member.

Numeral 90 indicates the flow path of atmospheric air into the annulus 76. Spacer 92 bottom supports the header 60 from the flange 78. Coupling 94 enables tubing 22 to be removed from the header 60.

In operation, thermostat 44 controls the action of burner 40 so that combustion products flow into the fire tube 38 on demand, where heat exchange takes place between the combustion products and the contents of the heater treater. Waste flue gases exit at 52 and flow into the heat exchanger annulus 76 at a location in close proximity to header 60. The upper terminal end of the housing of the heat exchanger preferably is located slightly above the top of the heater treater so that adequate stack action is achieved to cause both the flue gases as well as atmospheric air to flow upwardly through the housing in heat exchange relationship respective to the tube bundle contained therewithin.

Untreated crude oil at 22 enters the lower header and flows through the tube bundle in heat exchange relationship respective to the hot waste flue gases. The untreated crude oil is heated and flows from the exchanger outlet 28, which is also the untreated crude oil inlet for the heater treater, into the first section of the heater treater.

The temperature of the untreated crude is therefore elevated; and accordingly, the efficiency of the system is improved whereby greater throughput can be realized from the heater treater, or alternatively, a significant savings in combustion gases used at 40 is realized.

Furthermore, the treated crude exiting at 33 need not be placed in heat contact relationship with the incoming untreated cold crude as is often considered necessary; and therefore, the treated crude at 33 is more easily pumped through the remainder of the gathering system. Accordingly, the practice of using an oil-to-oil exchanger is unnecessary, thereby effecting a further savings.

In one embodiment of the invention, the outer housing of the waste heat exchanger is ten inches in diameter, pipe 22 is three inches in diameter, the header 60 is a three by six reducer, and tubes 64–68 are one and one-half inch diameter seamless steel tubes. The tube bundle comprises three ten-foot seamless tubing joints equally spaced apart on a common circle and attached to quarter-inch thick plate which forms the closure member in the lower and upper adjacent ends of the headers. The entire exchanger is twenty feet in height and extends several inches above the top of the heater treater so that wind blowing thereacross has little effect upon the operation thereof.

During the summer months, the damper is operated in the open position, which preferably is spaced about two and one-half inches from the apertured flange 78. As the load of the exchanger is increased, or as ambient temperatures decrease, the damper can be moved towards the closed position to adjust for season changes.

The present invention enables the heater treater to reach equilibrium much faster than in the prior art oil-to-oil heat exchanger; because as soon as burner 40 is ignited, the flue gases immediately commence heating the incoming crude at 22, whereas in the prior art oil-to-oil changer, the heater treater must heat the treated oil at 33 prior to the oil-to-oil exchanger heating up the incoming untreated crude, and equilibrium is accordingly established after a considerable time lapse. Hence the response rate of the present invention is very desirable. Another unforeseen advantage in the present invention is the provision of heated treated oil at 33, since the oil-to-oil heat exchanger has been eliminated, thereby lowering the viscosity of the oil and improving the pumping efficiency. Moreover, the savings in gas for the burner 40 is considerable. Since less gas is consumed for each barrel of oil treated, there is less pollution of the atmosphere.

Since the burner 40 is directly controlled by thermostat 44, and since the temperature rise imparted into the incoming crude by the waste heat exchanger is indirectly controlled by the burner 40, it follows that the system readily adjusts itself in a superior manner; and therefore, the efficiency of the system is enhanced as compared to the prior art oil-to-oil heat exchanger.

I claim:

1. In a heater treater having a crude oil inlet and a treated oil outlet, and an internal heating apparatus having a combustion-type gas burner means connected for heating the contents thereof and further including a waste gas outlet from said internal heating apparatus so that products of combustion from the burner heat the crude oil contained within the heater treater, the combination with said heater treater of a waste flue gas heat exchanger;

said heat exchanger includes an upright, elongated housing; means by which said housing is supportedly attached externally of the heater treater with a lower end thereof underlying the waste flue gas outlet and an upper end which terminates in proximity of the uppermost end of the heater treater;

an upper header, a lower header, a plurality of heat exchanger tubes having opposed ends with one opposed end of each tube being connected to the upper header and the other opposed end being connected to the lower header;

said upper and lower headers being arranged within said housing in spaced relationship therewith, means connecting said flue gas outlet to the lower marginal end of said housing in close proximity of said lower header so that flue gases can flow in heat exchange relationship respective to said tubes;

pipe means connecting said heat exchanger upstream of said crude oil inlet so that untreated crude oil flows through said pipe means and through said tubes and into said crude oil inlet;

means forming an adjustable air inlet at the lower end of said housing by which air can be admixed with flue gases to thereby control the temperature of the crude oil flowing therethrough;

said adjustable air inlet includes means forming a central opening through which said pipe means extends into fluid communication with said lower header so that untreated crude oil is preheated as it flows through said pipe means, into said lower header, through said tubes, into said upper header, and to said crude oil inlet.

2. The combination of claim 1 wherein said oil and said waste flue gases flow parallel to each other, and said tubes are radially spaced about the axial centerline of the housing.

3. The combination of claim 1 wherein said oil and said waste flue gases flow parallel to each other, and said tubes are radially spaced about the axial centerline of the housing;

said adjustable air inlet includes a plate member having a central opening through which said pipe means extends;

a flange forming the lower terminal end of the housing, said plate member being located below the flange and slidably received respective to the pipe means; and means adjusting the spaced relationship between the flange and the plate member.

4. The combination of claim 1 wherein said adjustable air inlet includes a flange, said flange is provided with radially spaced apertures, a threaded member attached to and extending from said flange and through said plate member, fastener means on the threaded member by which the plate member is supported in spaced relationship respective to the flange;

said central opening being formed through said plate member with said piping extending through said central opening;

said flange forms the lower terminal end of said housing, said plate member is located below the flange and slidably received respective to said piping so that untreated crude oil is preheated by the flue gases as the crude oil flows through the waste flue gas heat exchanger.

5. The combination of claim 4 wherein said flange is provided with radially spaced apertures, a threaded member extending from said flange and through said plate member, fastener means formed on said threaded member by which said plate is supported in spaced relationship to the flange.

6. In a heater treater having a crude oil inlet and a treated oil outlet, and an internal heating apparatus having a combustion-type gas burner means connected for heating the contents thereof and further including a waste gas outlet from said internal heating apparatus so that products of combustion from the burner heat the crude oil contained within the heater treater, the combination with said heater treater of a waste flue gas heat exchanger;

said heat exchanger having an upright, elongated housing supportedly attached externally of the heater treater with a lower end thereof underlying the waste flue gas outlet and an upper end which terminates in proximity of the uppermost end of the heater treater;

an upper header, a lower header, a plurality of heat exchanger tubes having opposed ends with one opposed end of each tube being connected to the upper header and the other opposed end being connected to the lower header;

said upper and lower headers being arranged within said housing in spaced relationship therewith, means connecting said flue gas outlet to the lower marginal end of said housing in close proximity of said lower header;

pipe means connecting said heat exchanger upstream of said crude oil inlet so that untreated oil flows through said tubes and into said crude oil inlet;

means forming an adjustable air inlet at the lower end of the housing by which air can be admixed with flue gases to thereby control the temperature of the oil flowing therethrough;

said adjustable air inlet includes a plate member having a central opening through which said pipe means extends;

a flange forming the lower terminal end of the housing, said plate member being located below the flange and slidably received respective to said pipe means; and means adjusting the spaced distance between the flange and the plate member, thereby adjusting the air flow through said heat exchanger housing.

7. The combination of claim 6 wherein said oil and said waste flue gases flow parallel to each other, and said tubes are radially spaced about the axial centerline of the housing.

8. The combination of claim 6 wherein said flange is provided with radially spaced apertures, a threaded member extending from said flange and through said plate member, fastener means formed on said threaded member by which said plate is supported in spaced relationship to the flange.

* * * * *